US006044541A

United States Patent [19]

Truong

[11] Patent Number: 6,044,541

[45] Date of Patent: Apr. 4, 2000

[54] METHOD OF MAKING BIMETALLIC COINS OR BLANKS

[75] Inventor: Hieu Cong Truong, Orleans, Canada

[73] Assignee: Royal Canadian Mint, Ottawa, Canada

[21] Appl. No.: 09/077,687

[22] PCT Filed: Dec. 4, 1996

[86] PCT No.: PCT/CA96/00800

§ 371 Date: Jun. 3, 1998

§ 102(e) Date: Jun. 3, 1998

[87] PCT Pub. No.: WO97/20701

PCT Pub. Date: Jun. 12, 1997

[30] Foreign Application Priority Data

Dec. 5, 1995 [CA] Canada ..... 2164495

[51] Int. Cl.[7] ..... B21D 39/00

[52] U.S. Cl. ..... 29/522.1; 40/27.5; 428/579; 428/609

[58] Field of Search ..... 29/522.1; 40/1.5, 40/27.5, 661.05, 675; 63/23, 34; 428/579, 600, 609

[56] References Cited

U.S. PATENT DOCUMENTS 3,636,616 1/1972 Remming ..... 40/27.5
4,472,891 9/1984 Ielpo ..... 40/27.5
5,094,922 3/1992 Ielpo et al. ..... 428/579
5,630,288 5/1997 Lasset et al. ..... 40/27.5

*Primary Examiner*—David P. Bryant
*Assistant Examiner*—Jermie E. Cozart

[57] ABSTRACT

A bimetallic coin or blank is produced from a disc-shaped core and an annular outer component. The metal alloy material of the core is relatively harder than the metal alloy material of the outer member. The two components are bonded to each other by pressure flow of the material of the core toward and into the inner edge of the outer member. According to the invention, the peripheral edge of the core is shaped or nosed such that it extends radially outwardly. During minting, the pressure of the dies causes the material of the core to flow radially outwardly, thus causing the shaped peripheral edge of the core to penetrate into the softer material of the outer member's inner edge and, thereby, form a tongue and groove connection which resists relative axial and rotational movement between the outer member and the core. The shaping of the core also facilitates the fast speed placement of the core into the ring during the minting operation. The invention is particularly, but not exclusively, useful in the production of thin coins having the thickness range of about 1.0 mm to about 1.5 mm, where the locking of the two components is difficult to achieve with known methods.

49 Claims, 6 Drawing Sheets

METHOD OF MAKING BIMETALLIC COINS OR BLANKS

FIELD OF INVENTION

The present invention relates to the manufacture of bimetallic coins of the type having a centrally disposed core from one metal or alloy, and an annular outer member from another metal or alloy, the two being bonded to each other by plastic deformation under pressure.

One of the serious problems associated with the production of this type of coins is in that the bond between the core and the outer portion of the coin could be insufficient, particularly with respect to preventing axial displacement or even removal of the two sections from each other.

PRIOR ART

To this end, many solutions have been suggested in prior art. For instance, U.S. Pat. No. 632,938 (Greenburg) provides a reverse-bevelled inner edge on the annular member. A thicker and softer cylindical insert is positioned within the opening and is compressed such that the softer excess material of the insert flows over the bevelled edge of the annular member.

Japanese published application (Kokai) No. 58-3743 (Hisanobu) discloses a coin structure including a peripheral groove and key joint between the two elements. This is an expensive proposition requiring a complex manufacturing procedure which is particularly difficult if a very large number of coins is to be produced.

The same applies to other known proposals. For instance, Canadian Patent No. 1,103,431 (Hisanobu et al.) shows a method wherein two elements similar to the coin portions are coupled to each other by an insert which is forced by an impact to flow into grooves of the two elements. Such production is complex and expensive as an additional component is required for the manufacture.

Canadian Patent No. 1,195,058 (lelpo) proposes an interlocking arrangement much in the fashion of a tongue-and-groove which is difficult to apply in a mass production due to relative complexity of the structure. In this case, the outer ring has a circumferential tongue disposed along its interior on which is provided a series of teeth. The softer material of the insert is forced under pressure over the tongue and teeth. The tongue prevents axial separation of the elements while the teeth prevent relative rotational movement therebetween.

The coin shown in Canadian Patent No. 1,317,746 (Lasset et al.) is likewise complex and expensive to produce. Here, one of the elements, the harder inner member, is provided with a series of cavities into which the material of the softer outer ring is forced to flow by the minting operation.

A somewhat similar structure is disclosed in Canadian Published Patent Application No. 2,092,941 (Seuster et al.), where continuous or discontinuous grooves are proposed to be made in the edge portion of the core to receive impact forced flow of material of the outer ring. As in the preceding example, the provision of the cavities in the periphery of the inner core would be very expensive as it would require special tools. The difference between the inner diameter of the outer ring and the outside diameter of the core is relatively small. This often gives rise to difficulties when it is desired to feed the cores into the rings at a high speed as too many core blanks do not reach their position in the centre resulting in a high frequency of press stoppage.

European Patent Application No. 415,892 in the name of Lelpo describes a structure composed of an external ring and an insert. A series of spaced grooves is cut perimetrally in the edge surface of the ring. A perimetral ridge is formed on the edge surface of the insert. During the minting, plastic flow of material takes place from the ridge into the grooves in the external ring.

European Patent Application No. 678,251 in the name of Kim (Poongsan Corporation) describes a bimetallic coin and method of producing the same. The method involves forming a ring and an insert. A groove is formed on the edge of the insert. Emphasis is put on the thickness of the insert relative to the ring.

European Patent Application No. 080,437 (Instituto Poligraphico E Zecca Dello Stato) also describes a bimetallic composite coin blank having an insert and an outside ring. The specification requires that the inside wall of the outside ring has protruding teeth which form the interference for locking the ring with an insert.

The common drawback of methods known from prior art is that they are not well suited for use in the production of thin coins having a thickness in the range of about 1.0 mm to about 1.5 mm. In addition, their structures give rise to problems relating to the accurate and consistent placement of the cores within the outer members, particularly during high speed minting operations.

SUMMARY OF THE INVENTION

It is an object of the present invention to advance the art of coin making by providing a method, a blank and a coin so structured that it is relatively inexpensive to produce and at the same time presents a reduction of occurrences of missed placement of the core into the opening of the annular ring of the coin in a fast speed mass production.

It is another object of the invention to provide a method and structure of a blank and of a coin particularly—but not exclusively—suited for the manufacture of thin coins typically having a thickness of about 1.0 mm to about 1.5 mm. Preferably, but not necessarily, the core member is circular and is disposed generally centrally of the outer member.

In general terms, and viewed in one aspect of the present invention, there is provided a method of making a bimetallic coin, token, medal or the like, comprising the steps of:

(a) providing an outer member from a first metal alloy, the outer member including:
  (i) generally parallel, opposed face sections spaced apart a predetermined distance corresponding to the initial thickness of the outer member;
  (ii) an inner edge defining an opening in the outer member; and
  (iii) an outer edge;

(b) providing a core member from a second metal alloy different from the first metal alloy, the second metal alloy being harder than the first metal alloy by a predetermined relative amount, the core including:
  (i) generally parallel, opposed face portions spaced apart a predetermined distance corresponding to the initial thickness of the core member, each face portion having a peripheral rim which extends a predetermined distance above its respective face portion;
  (ii) a peripheral edge extending outwardly between the rims, the outer edge having a predetermined cross-sectional shape;
  (iii) there being a predetermined spacing between the peripheral edge of the core member and the inner edge of the outer member, adapted to allow a closely spaced but free placement of the core member in the opening;

(c) placing the core member in the opening; and (d) plastically bonding the core member and the outer member together by plastically deforming by pressure the core member and the annular member to cause the outwardly extending peripheral edge of the core member to penetrate radially into the inner edge section of the outer member.

In another aspect, the invention provides a method of making a bimetallic coin, token, medal or the like, comprising the steps of:

(a) providing an outer member from a first metal alloy, the outer member including:

(i) generally parallel, opposed face sections spaced apart a predetermined distance corresponding to the initial thickness of the outer member;

(ii) an inner edge defining an opening in the outer member; and (iii) an outer edge;

(b) providing a core member from a second metal alloy different from the first metal alloy, the second metal alloy being harder than the first metal alloy by at least about 8 points on the R30T scale, the core member having generally parallel, opposed face portions spaced apart a predetermined distance corresponding to the initial thickness of the core member, the initial thickness of the core member being substantially the same as the initial thickness of the outer member;

(c) rimming the core member to form an peripheral edge of predetermined cross-sectional shape, the peripheral edge including rim portions at or near the periphery of both face portions of the core member, the peripheral edge extending outwardly to an outermost portion with the thickness of the peripheral edge decreasing from the rim portions to the outermost portion, there being a predetermined spacing between the outermost portion of the peripheral edge of the core member and the inner edge of the outer member, adapted to allow a closely spaced but free placement of the core member in the opening;

(d) placing the core member in the opening; and (e) plastically bonding the core member and the outer member together by plastically deforming by pressure the core member and the annular member to cause the outwardly extending peripheral edge of the core member to penetrate radially into the inner edge section of the outer member.

In another aspect but still defined in general terms, the invention provides an inner core the inner core for use in making a bimetallic coin of the type having an outer peripheral portion from a first alloy and the inner core from a second alloy, the second alloy being harder than the first alloy by a predetermined relative amount, the inner core including:

(i) a generally flat, first face portion and an opposed, generally flat, second face portion;

(ii) the first and second face portions being spaced apart a predetermined distance corresponding to the initial thickness of the inner core;

(iii) a radially outwardly extending peripheral edge having a predetermined cross-sectional shape, the peripheral edge including rim portions extending outwardly at the periphery of both face portions of the inner core.

In general, the outwardly extending peripheral edge of the core member reduces in cross-sectional axial thickness from the rims to its outermost radial extent, thereby providing a penetrating nose of harder material. During the minting operation, this nose is caused to penetrate into the softer material of the outer member to form a tongue-and-groove connection which resists relative axial and/or rotational movement between the core and outer member.

The peripheral edge of the core member may slope or taper or curve convergingly to an outer edge face which is generally perpendicular to the core faces and preferably has a width of about 50–70% of the core's initial thickness. The cross-sectional shape of the peripheral edge in this case may be generally trapezoidal in shape wherein angled surfaces extend between the rims and the outer edge face at an angle of about 15–35° relative to the respective face of the core. Alternately, the peripheral edge may be outwardly rounded with a radius of curvature preferably from about 0.8 to about 1.8 times the core's initial thickness. These shapings of the core's outer edge can be effected in a rimming operation anytime prior to placement in the outer member.

The invention also provides for a coin, medal, token, check or the like produced in accordance with the disclosed methods.

These and other features of the invention will be described in more detail hereinbelow with reference to the attached drawings.

BRIEF DESCRIPTION OF THE DRAWINGS

The invention will now be described by way of a preferred embodiment, with reference to the accompanying diagrammatic, simplified not-to-scale drawings. In the drawings.

DETAILED DESCRIPTION

Figure 1:
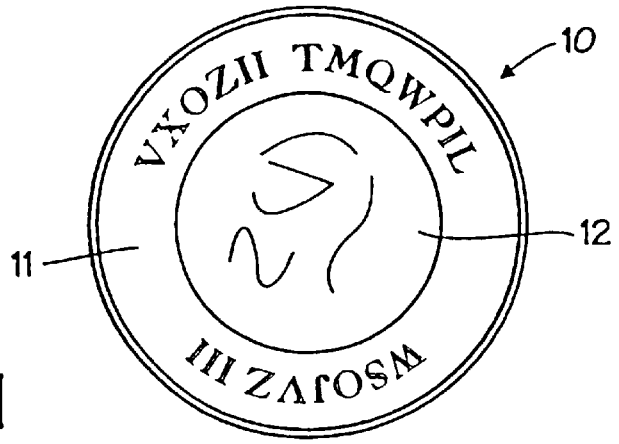
FIG. 1 is a top plan view of a bimetallic coin of the present invention.

Referring to FIG. 1, the bimetallic coin 10 is comprised of an outer annular member 11 and of a disc-shaped core member 12. The outer member 11 is made of a soft material relative to the core member 12, having a low resistance to deformation flow. The core member 12, on the other hand, is made from a relatively harder material. It will be appreciated that a number of different alloys of metals differing from each other can be used. The coin 10 as illustrated in FIG. 1 shows an annular outer member 11 with a centrally disposed circular core member 12. It will be further appreciated that such an embodiment is exemplary and that blanks of various alternate shapes may be employed within the context of the present invention.

Figure 3:
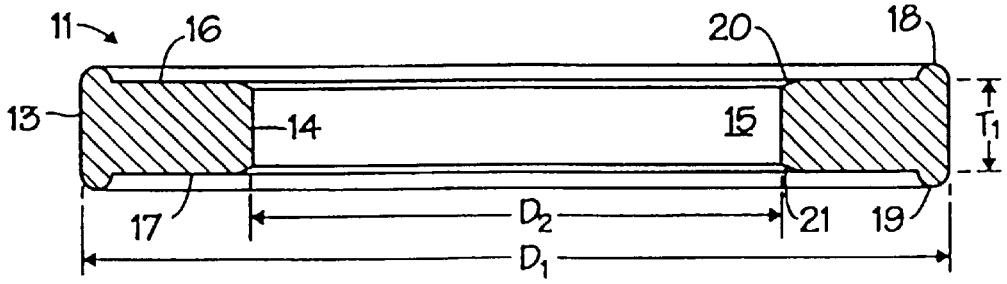
FIG. 3 is an even more enlarged cross-sectional view of the blank of the outer member of the coin of FIG. 2 as it is prior to minting.

The blank of the outer annular member 11 comprises, as shown in FIG. 3, a generally cylindrical outer edge section 13. The cylindrical edge 13 has a predetermined outside diameter $D_1$, in the example shown, about 28 mm. The inner edge section 14 defines an opening 15 having the inside diameter $D_2$ of about 16.3 mm. The initial thickness $T_1$ of the outer member 11 as measured between the generally flat first and second annular face sections 16, 17 is about 1.40 mm. The surface of the inner edge section 18 is generally perpendicular to the first and second annular face sections 16, 17. Rims 18, 19 may be provided at the periphery of the first and second annular face sections 16, 17, respectively, by way of a rimming operation performed on the blank of the outer member 11. In order to further facilitate registration of the core member 12 within the opening 15, the corners 20, 21 between the face sections 16, 17 may be bevelled slightly so that the core member 12, if slightly misaligned during placement, will be guided into the opening 15. These corners 20, 21 can be included during the stamping operation which makes the outer member 11 or by any other known technique.

Figure 2:
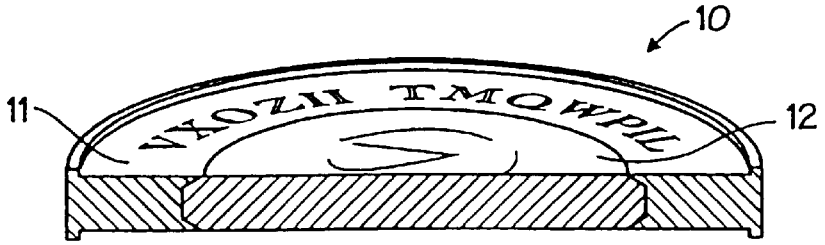
FIG. 2 is an enlarged sectional view of a first embodiment of the bimetallic coin of FIG. 1.
Figure 4:
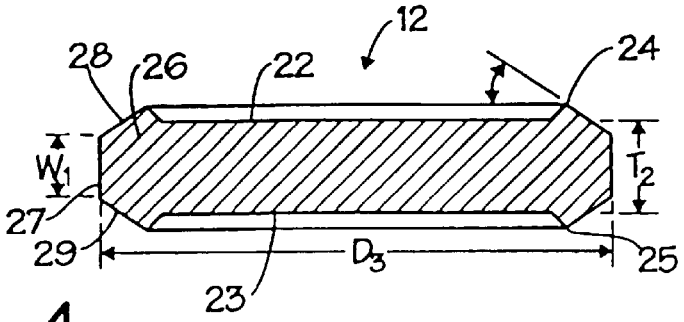
FIG. 4 is an even more enlarged cross-sectional view of the blank of the core member of the coin of FIG. 2 as it is prior to minting.

As shown in FIG. 4, the core member 12 for use in making the coin 10 illustrated in FIG. 2 has a generally flat first circular face portion 22 and an opposed, second generally flat circular face portion 23. The initial thickness $T_2$ of the core member 12, which in the example shown is about 1.40 mm. The face portions 22, 23 each have a rim 24, 25 disposed about their peripheries. A peripheral edge extends radially outwardly between the rims 24, 25 to a maximum outside diameter $D_3$ of the core 12. The diameters $D_2$ and $D_3$ and their tolerances depend on the materials involved and the size of the components. The functional consideration is that the core 12 must easily slip into the opening 15 during the high speed manufacture. At the same time, the spacing cannot be too large, otherwise, the interference between the two materials would be insufficient.

In the embodiment shown in FIGS. 2 to 6, the peripheral edge 26 has a generally trapezoidal cross-sectional shape which tapers or reduces in thickness from the rims 24, 25 to an outer face edge 27. The outer face edge 27 is generally perpendicular to the first and second face portions 22, 23 and its width $W_1$ is less than the initial outer member thickness $T_1$. Since the initial core thickness $T_2$ is preferably substantially the same as the initial outer member thickness $T_1$, it follows that the outer edge face width $W_1$ will be generally less than the initial core thickness $T_2$. In general, the outer edge face width $W_1$ should be at most 50–70% of the initial core thickness $T_2$ as will be explained in greater detail hereinbelow. Interfacing between the outer edge face 27 and the rims 24, 25, are angled surfaces 28, 29. One of the functions of these angled surfaces 28, 29 is to facilitate placement of the core member 12 within the opening 15 of the outer member 11 prior to minting. Preferably, the enclosed angle $\alpha$ that the angled surfaces 28, 29 make with the corresponding face portions 22, 23 is on the order of about 15–35°. The rims 24, 25 have, in this embodiment, a generally triangular cross-sectional profile with the outermost side being substantially continuous with the angled surfaces 28, 29 of the peripheral edge 26. The rims 24, 25 can be provided along with the shape of the peripheral edge 26 in the same rimming operation.

FIGS. 5A through 5D illustrate diagrammatically the manner in which the core member 12 and the outer member 11 are joined. When producing the bimetallic coin 11 shown in FIG. 2, the outer annular member 11 is placed (FIG. 5A) in a press collar which includes a collar section 30 corresponding to the outer configuration of the outer member 11, a lower die 31 and an upper die 32. It should be noted at this point that the two dies 31, 32 are adapted to move into and out of the cavity defined by the collar section 30. The impact faces 33, 34 of the dies 31, 32 are each slightly convexly rounded. The radius of the rounding is very large, resulting in the difference R between the forwardmost point of the face 33, 34 and its rearmost point (the latter being usually near the periphery of the die 31, 32) being in the order of mere 0.01–0.25 mm, depending on the size of the coin.

In the embodiment shown, the two dies 31, 32 are parts attached to a minting press. In such presses, it is important that the blank components of the coins produced be delivered at a very high speed, yet reliably, to the collar section 30. In prior art, this poses a problem due to the relatively small tolerance between the diameters of the core 12 ($D_3$) and that of the opening 15 ($D_2$). As mentioned above, the occurrence of the core 12 not reaching a proper position in the respective opening 15 before the stroke of the die(s) was relatively high and resulted in a high frequency of the press stoppage and low productivity.

The invention presents a simple and effective solution to the problem. The outwardly extending peripheral edge 26 and, more particularly, the angled surface 29 presents a reduction of the diameter of the core near the face 23 which is the first to reach the annular member 11 already in the feeding plate or disk plate. This shaping provides a "funnel" effect in guiding the core 12 into the opening 15. If bevelled edges 20, 21 have been provided about the opening 15 of the outer member, this further increases the effectiveness of accurate, consistent placement.

Figure 5A:
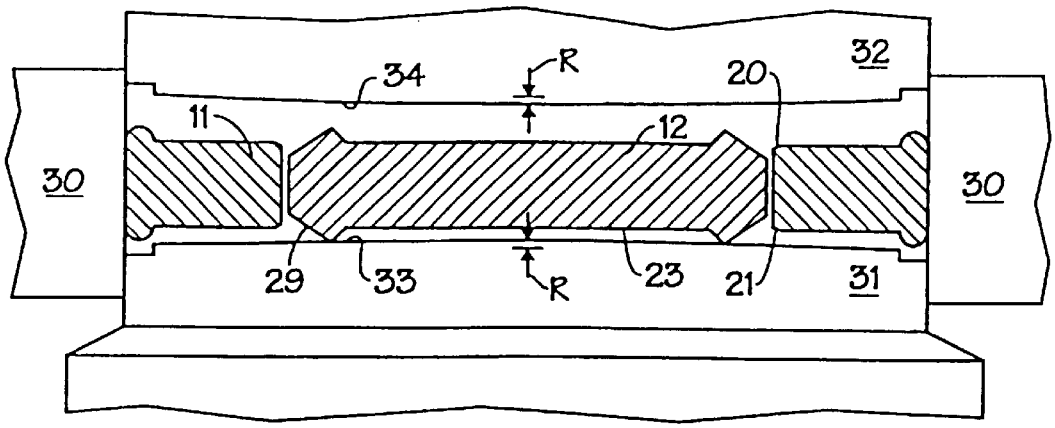
FIGS. 5A to 5D are diagrammatic representations illustrating the manner in which the outer member and core member of the coin embodiment of FIG. 2 are joined in a device for carrying out the method of the present invention.
Figure 5B:
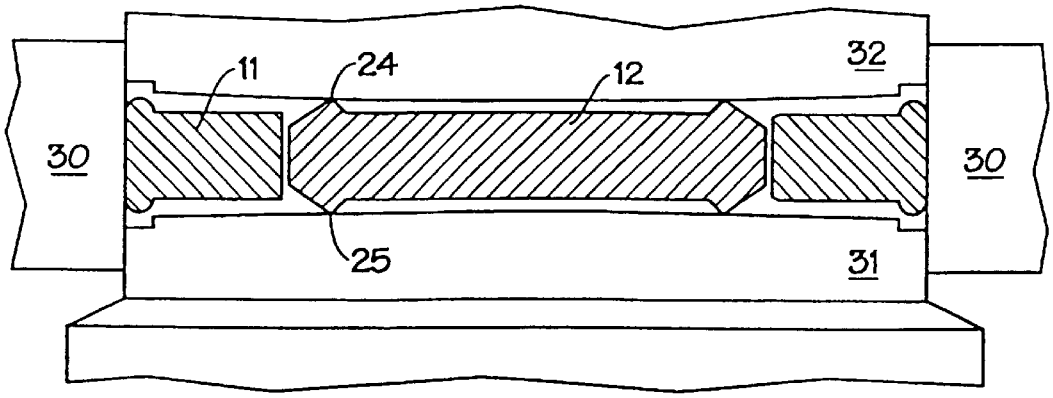
Figure 5C:
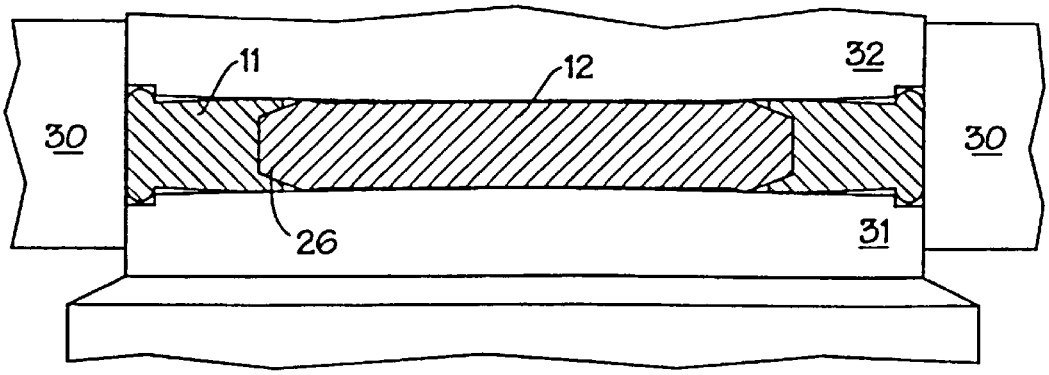
Figure 5D:
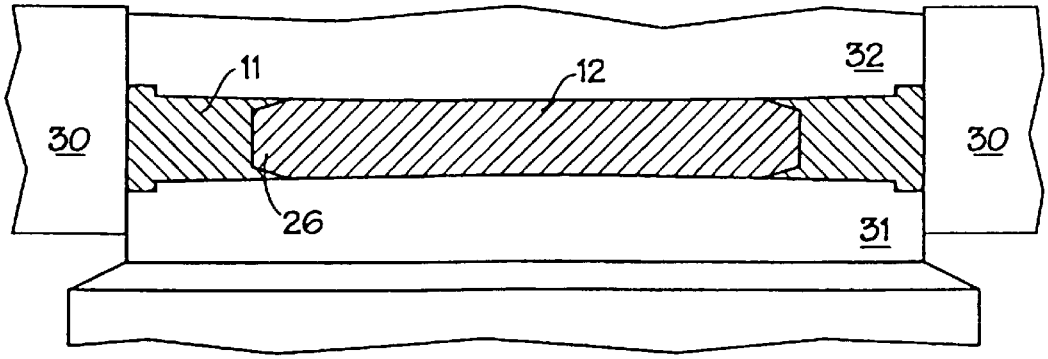
Figure 6:
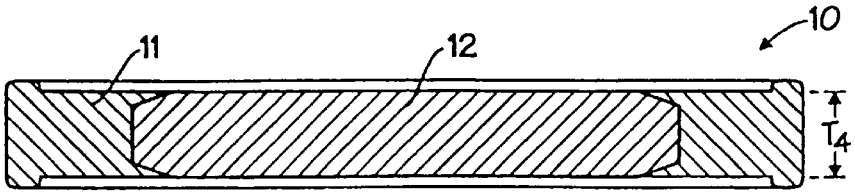
FIG. 6 is a cross-sectional view of the resultant coin of the first embodiment after minting.
Figure 7:
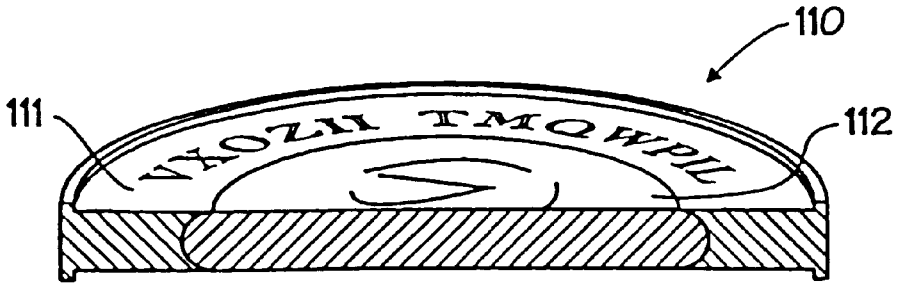
FIG. 7 is an enlarged sectional view of a second embodiment of the bimetallic coin of FIG. 1.
Figure 8:
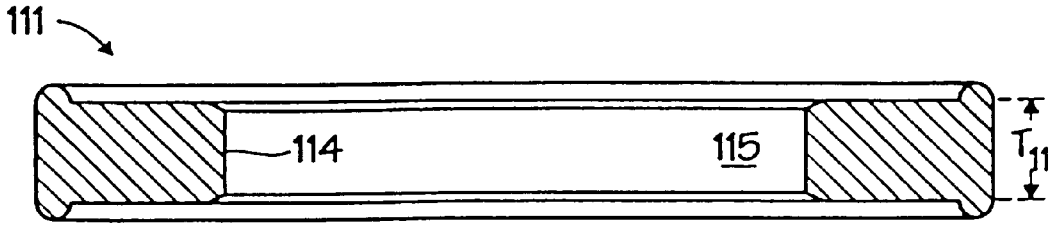
FIG. 8 is an even more enlarged cross-sectional view of the blank of the outer member of the coin of FIG. 7 as it is prior to minting.
Figure 9:
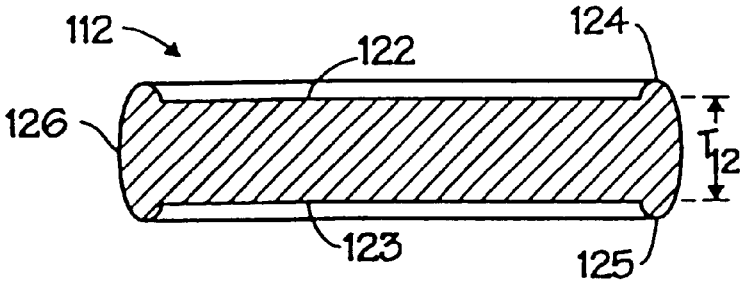
FIG. 9 is an even more enlarged cross-sectional view of the blank of the core member of the coin of FIG. 7 as it is prior to minting.

When the operation of the press (diagrammatically indicated in FIG. 5B) is commenced, the dies 31, 32 first contact the core member 12 and, more specifically, the rims 24, 25 of the core member due to the radius of curvature R of the dies 31, 32 (see FIG. 5A). This causes the rims 24, 25 to compress and the material thereof to flow toward each other and outwardly which pushes or urges the material in the peripheral edge 26 to flow radially outwardly. Since the material of the core member 12 is harder than the material of the outer member 11, the peripheral edge 26 of the core 12 will penetrate into the inner edge section 14 of the outer member 11 (see FIG. 5C). As this is occurring, the material of the outer member is prevented from flowing axially due to the confines of the upper and lower dies, 32, 31 (see FIG. 5D). The additional material in the rims 24, 25 should be sufficient to make up for the reduction in material in the peripheral edge and the overall difference in material due to the spacing between the outer member 11 and core 12. In this manner, the thickness of the member from which the material essentially flows, in this case the core's initial thickness $T_2$, need not be uniformly greater than the other member's thickness, in this case, the outer member's initial $T_1$. Of course, the exact shaping and dimensions chosen will be dependent upon the materials selected, their relative hardnesses and resistances to flow and desired end thickness $T_4$ of the resultant coin (see FIG. 6) balanced by the need to ensure proper registration of the core within the outer member during high speed minting operations and to ensure a secure joining of the two members. Obviously, the minting impact which gives rise to the flow of the alloys also reduces the final thickness of the two components of the coin at the center or close to the center. This is relatively difficult to measure accurately due to the contour on each of the faces of the finished coin. However, referring to the examples presented above, the final thickness $T_4$ at the region of the penetration of the core alloy into the inner edge section 14 of the outer member is about 1.24 mm.

As indicated above, the alloy material from which the core member 12 is made should be harder than the material from which the outer member 11 is made to ensure sufficient penetration of the core material into the outer member material and, thereby, ensure adequate connection strength. The actual difference in hardness thus required is difficult to specify due to the variety of other factors involved, such as the shape and dimension of the components. Preferably, there will be a hardness diffence of at least approximately 8 points on the R30T scale.

Thus, a firm bond is established in accordance with the method of the invention between the outer member 11 and the core 12. The forcing of the relatively hard core material into the inner edge section 14 of the outer member 11 gives rise to a tongue-and-groove connection which effectively locks the core 12 against axial displacement relative to the outer annular member 11. The interference of the two materials effectively prevents relative rotation between the outer member 11 and the core 12.

Figure 10A:
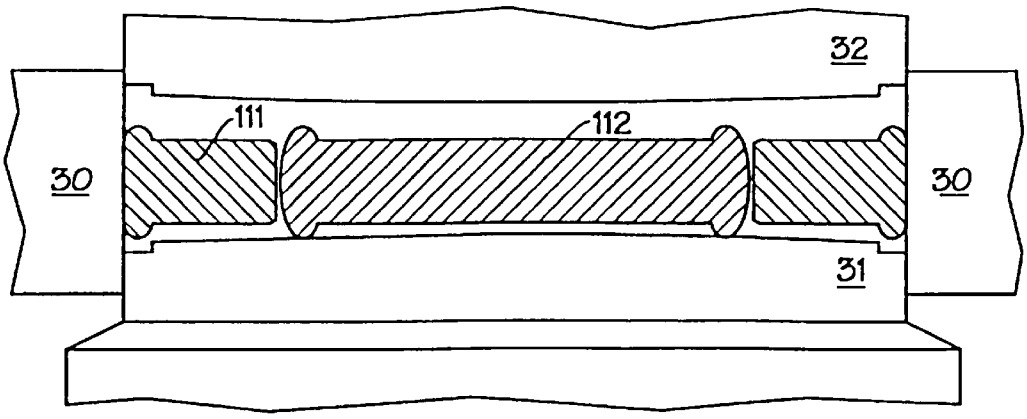
FIGS. 10A to 10D are diagrammatic representations illustrating the manner in which the outer member and core member of the coin embodiment of FIG. 7 are joined in a device for carrying out the method of the present invention.
Figure 10B:
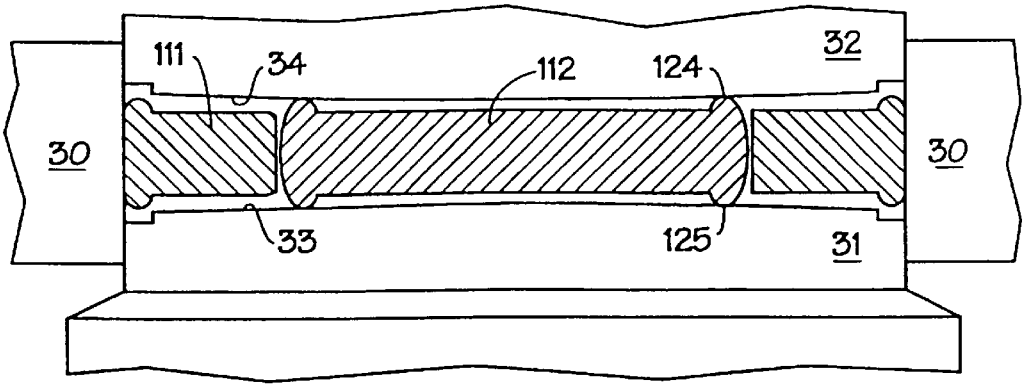
Figure 10C:
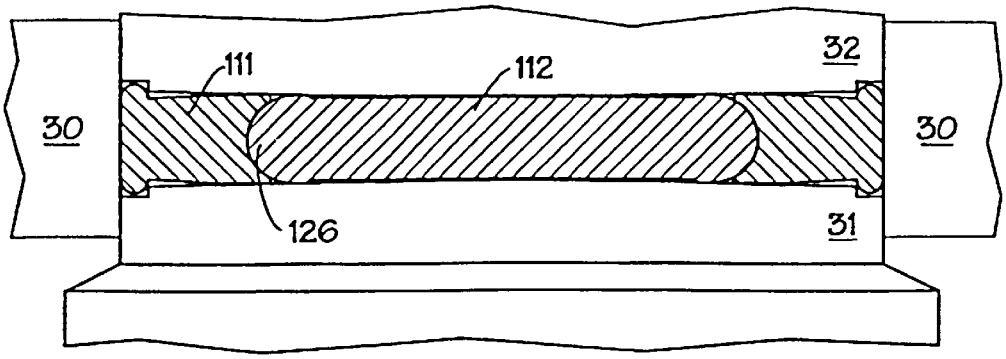
Figure 10D:
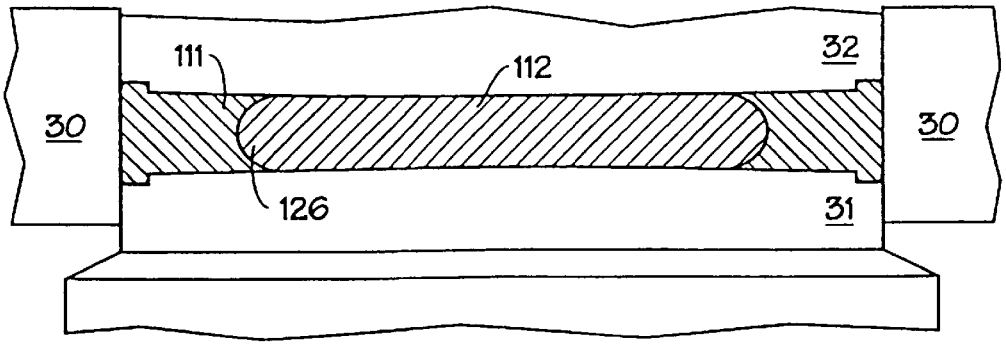

The peripheral edge 26 can be of different shape as can the rims 24, 25. In the embodiment of the coin 110 shown in FIGS. 7 through 11, the outer member 111 is substantially the same as the outer member 11 of the previous embodiment, having an initial thickness $T_{11}$. The core member 112 is generally the same as core member 12 in that it has opposed, generally flat first and second face portions 122, 123 having disposed at or near their peripheries, a respective rim 124, 125. In this case, however, the rims 124, 125 have a curved cross-sectional profile which meets smoothly and continuously with the peripheral edge 126 which is radially outwardly rounded. The contoured peripheral edge still presents a reduction of the diameter of the core near the face 123 which is the first to reach the annular member 111 already in the feeding plate or disk plate (see FIG. 10A). As with the angled surface 29 of the previous embodiment, this facilitates registration of the core 112 within the opening 115 of the outer member 111 during high speed minting operations. The appropriate magnitude of radius of curvature of the peripheral edge 126 is dependent again upon material and dimensional considerations of the components involved—too flat will result in insufficient depth of penetration while too "pointed" will require more substantial rim volume. It has been found, however, that a radius of curvature of between about 0.8 to about 1.8 times the initial thickness $T_{12}$ of the core member results in a secure connection between the inner core member 112 and the outer member 111.

Figure 11:
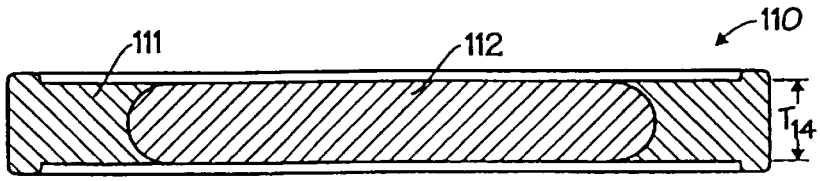
FIG. 11 is a cross-sectional view of the resultant coin of the second embodiment after minting.

FIGS. 10A–10D illustrate the manner in which the material of the core member is caused to penetrate into the inner edge 114 of the outer member 111, to result in the bimetallic coin 110 as shown in FIG. 11 of final thickness $T_{14}$.

Those skilled in the art will appreciate that the embodiments disclosed may be modified, to a greater or lesser degree, without departing from the invention as claimed. For example, while there has been shown and described the manufacture of a coin having an annular outer member and a centrally disposed disc-shaped core, the outer member and core can be of any generally planar shape, wherein the shape of the opening in the outer member corresponds closely with the outer shape of the core member. The method of the invention is not only limited to the production of coins, but equally to checks, tokens, medals and the like. It will therefore be appreciated that various modifications and/or substitutions made be made thereto without departing from the spirit and scope of the invention as defined in the appended claims.

What is claimed is:

1. A method of making a bimetallic coin, token, or medal, comprising the steps of:

(a) providing an outer member from a first metal alloy, said outer member including:
  (i) generally parallel, opposed face sections spaced apart a predetermined distance corresponding to the initial thickness of said outer member;
  (ii) an inner plain edge devoid of teeth and grooves, the edge defining an opening in said outer member; and
  (iii) an outer edge;

(b) providing a core member from a second metal alloy different from said first metal alloy, said second metal alloy being harder than said first metal alloy by a predetermined relative amount, said core including:
  (i) generally parallel, opposed face portions spaced apart a predetermined distance corresponding to the initial thickness of said core member, each face portion having a peripheral rim which extends a predetermined distance above its respective face portion;
  (ii) a peripheral edge extending outwardly between the rims, said outer edge having a predetermined cross-sectional shape;
  (iii) there being a predetermined spacing between the peripheral edge of said core member and said inner edge of said outer member, adapted to allow a closely spaced but free placement of the core member in said opening;

(c) placing said core member in the opening; and (d) plastically bonding the core member and the outer member together by plastically deforming by pressure the core member and the outer member to cause said outwardly extending peripheral edge of said core member to penetrate radially into the inner edge section of said outer member.

2. The method of claim 1, wherein said predetermined relative amount of hardness between said first metal alloy and said second metal alloy is at least about 8 points of the R30T scale.

3. The method of claim 2, wherein the predetermined cross-sectional shape of said peripheral edge of the core member is generally trapezoidal and comprises an outer edge face and an angled surface extending between said outer edge face and each said rim.

4. The method of claim 3, wherein the width of said outer edge face is from about 50–70% of the initial thickness of the core member.

5. The method of claim 4, wherein each said angled surface extends between said outer edge face and its respective rim at an angle of about 15–35° relative to the respective face portion of the core.

6. The method of claim 2, wherein the predetermined cross-sectional shape of said peripheral edge of the core member has a rounded outer surface.

7. The method of claim 6, wherein the radius of curvature of said rounded outer surface is from about 0.8 to about 1.8 times the initial thickness of the core member.

8. The method of claim 7, wherein said rim has a rounded cross-sectional profile which has a surface generally continuous with the rounded outer surface of said peripheral edge.

9. The method of claim 1, wherein the predetermined cross-sectional shape of said peripheral edge of the core member includes an outer edge face which is generally perpendicular to said face portions and, extending between said outer edge face and each said rim, is an interface surface.

10. The method of claim 9, wherein the width of said outer edge face is from about 50–70% of the initial thickness of the core member.

11. The method of claim 10, wherein each said interface surface extends between said outer edge face and its respective rim at an angle of about 15–35° relative to the respective face portion of the core.

12. The method of claim 11, wherein said rim has a generally triangular cross-sectional profile.

13. The method of claim 1, wherein the initial thicknesses of the core and the outer member are the same.

14. The method of claim 1, wherein the rims and shaping of the peripheral edge are produced in a rimming operation.

15. The method of claim 1, wherein the step (d) is effected while minting the core member and the outer member in a collar by a convexly curved minting tool to thus commence the minting of the core member prior to the commencement of the minting of the outer member, whereby the minting results in flow of said second metal alloy principally toward and into the inner edge section defining said opening, thus bonding of the two members with each other in a tongue and groove manner.

16. The method of claim 15, wherein said convexly curved minting tool engages first the rims of the core member causing the material of the rims to flow and thereby urge said peripheral edge outwardly and into said inner edge section.

17. A method of making a bimetallic coin, token, or medal, comprising the steps of:

(a) providing an outer member from a first metal alloy, said outer member including:
  (i) generally parallel, opposed face sections spaced apart a predetermined distance corresponding to the initial thickness of said outer member;
  (ii) an inner plain edge devoid of teeth and grooves, the inner edge defining an opening in said outer member; and
  (iii) an outer edge;

(b) providing a core member from a second metal alloy different from said first metal alloy, said second metal alloy being harder than said first metal alloy by at least about 8 points on the R30T scale, said core member having generally parallel, opposed face portions spaced apart a predetermined distance corresponding to the initial thickness of said core member, said initial thickness of said core member being substantially the same as the initial thickness of said outer member;

(c) rimming said core member to form an peripheral edge of predetermined cross-sectional shape, said peripheral edge including rim portions at or near the periphery of both face portions of the core member, said peripheral edge extending outwardly to an outermost portion with the thickness of the peripheral edge decreasing from said rim portions to said outermost portion, there being a predetermined spacing between the outermost portion of the peripheral edge of said core member and said inner edge of said outer member, adapted to allow a closely spaced but free placement of the core member in said opening;

(d) placing said core member in the opening; and (e) plastically bonding the core member and the outer member together by plastically deforming by pressure the core member and the annular member to cause said outwardly extending peripheral edge of said core member to penetrate radially into the inner edge section of said outer member.

18. The method of claim 17, wherein the step (e) is effected while minting the core member and the outer member in a collar by a convexly curved minting tool to thus commence the minting of the core member prior to the commencement of the minting of the outer member, whereby the minting results in flow of said second metal alloy principally toward and into the inner edge section defining said opening, thus bonding of the two members with each other in a tongue and groove manner.

19. The method of claim 18, wherein said convexly curved minting tool engages first the rims of the core member causing the material of the rim portions to flow and thereby urge said peripheral edge outwardly and into said inner edge section of said outer member.

20. The method of claim 18, wherein the width of said outer edge face is from about 50–70% of the initial thickness of the core member.

21. The method of claim 17, wherein the predetermined cross-sectional shape of said peripheral edge of the core member is generally trapezoidal and comprises an outer edge face and an angled surface extending between said outer edge face and each said rim portion.

22. The method of claim 18, wherein each said angled surface extends between said outer edge face and its respective rim portion at an angle of about 15–35° relative to the respective face portion of the core.

23. The method of claim 17, wherein the predetermined cross-sectional shape of said peripheral edge of the core member includes an outer edge face which is generally perpendicular to said face portions and, extending between said outer edge face and each said rim portion, is an interface surface.

24. The method of claim 23, wherein the width of said outer edge face is from about 50–70% of the initial thickness of the core member.

25. The method of claim 24, wherein each said interface surface extends between said outer edge face and its respective rim portion at an angle of about 15–35° relative to the respective face portion of the core.

26. The method of claim 25, wherein said rim portion has a generally triangular cross-sectional profile.

27. The method of claim 17, wherein the predetermined cross-sectional shape of said peripheral edge of the core member has a rounded outer surface.

28. The method of claim 27, wherein the radius of curvature of said rounded outer surface is from about 0.8 to about 1.8 times the initial thickness of the core member.

29. The method of claim 28, wherein said rim portion has a rounded cross-sectional profile which has a surface generally continuous with the rounded outer surface of said peripheral edge.

30. A method of making a bimetallic coin, token, or medal, comprising the steps of:

(a) manufacturing an outer, generally annular member from a first metal alloy, said outer generally annular member including:
  (i) a generally cylindrical outer edge section having a predetermined outside diameter;

(ii) a generally cylindrical inner edge section having a predetermined inside diameter, defining a centrally disposed circular opening in said annular member; and (iii) a generally flat first annular face section and an opposed, generally flat second annular face section, said annular face sections being spaced apart a predetermined distance corresponding to the initial thickness of said outer annular member;

(b) manufacturing a disc-shaped core member from a second metal alloy different from said first metal alloy, said second metal alloy being harder than said first metal alloy by a predetermined relative amount, said core including:

(i) a generally flat, first face portion and an opposed, generally flat, second face portion;

(ii) said first and second face portions being spaced apart a predetermined distance corresponding to the initial thickness of said core member, each face portion having a peripheral rim which extends a predetermined distance above its respective face portion;

(iii) a peripheral edge extending outwardly between the rims, said outer edge having a predetermined cross-sectional shape; and (iv) a peripheral, edge section of predetermined cross-sectional shape and dimension extending between the face sections and having a predetermined maximum outside diameter;

(v) there being a predetermined spacing between the predetermined maximum outside diameter of the core member and said predetermined inside diameter of the outer annular member, adapted to allow a closely spaced but free placement of the core member in said opening;

(c) placing said disc-shaped core member in the opening; and (d) plastically bonding the core member and the annular member together by plastically deforming by pressure the core member and the annular member to cause said edge section of said core member to penetrate radially into the cylindrical inner edge section of said annular member to form a tongue-and-groove connection therebetween.

31. The method of claim 30, wherein said predetermined relative amount of hardness between said first metal alloy and said second metal alloy is at least about 8 points on the R30T scale.

32. The method of claim 31, wherein the predetermined cross-sectional shape of said peripheral edge of the core member is generally trapezoidal and comprises an outer edge face and an angled surface extending between said outer edge face and each said rim.

33. The method of claim 32, wherein the width of said outer edge face is from about 50–70% of the initial thickness of the core member.

34. The method of claim 33, wherein each said angled surface extends between said outer edge face and its respective rim at an angle of about 15–35° relative to the respective face portion of the core.

35. The method of claim 31, wherein the predetermined cross-sectional shape of said peripheral edge of the core member has a rounded outer surface.

36. The method of claim 35, wherein the radius of curvature of said rounded outer surface is from about 0.8 to about 1.8 times the initial thickness of the core member.

37. The method of claim 36, wherein said rim has a rounded cross-sectional profile which has a surface generally continuous with the rounded outer surface of said peripheral edge.

38. The method of claim 30, wherein the predetermined cross-sectional shape of said peripheral edge of the core member includes an outer edge face which is generally perpendicular to said face portions and, extending between said outer edge face and each said rim, is an interface surface.

39. The method of claim 38, wherein the width of said outer edge face is from about 50–70% of the initial thickness of the core member.

40. The method of claim 39, wherein each said interface surface extends between said outer edge face and its respective rim at an angle of about 15–35° relative to the respective face portion of the core.

41. The method of claim 40, wherein said rim has a generally triangular cross-sectional profile.

42. The method of claim 30, wherein the initial thicknesses of the core and the outer member are the same.

43. The method of claim 30, wherein the rims and shaping of the peripheral edge are produced in a rimming operation.

44. The method of claim 30, wherein the step (d) is effected while minting the core member and the outer annular member in a collar by a convexly curved minting tool to thus commence the minting of the core member prior to the commencement of the minting of the outer annular member, whereby the minting results in flow of said second metal alloy principally toward and into the inner edge section defining said opening, thus bonding of the two members with each other in a tongue and groove manner.

45. The method of claim 44, wherein said convexly curved minting tool engages first the rims of the core member causing the material of the rims to flow and thereby urge said peripheral edge outwardly and into said inner edge section of said outer annular member.

46. The method of claim 30, wherein said circular opening includes bevelled edges between said cylindrical inner edge section and each said annular face section.

47. A bimetallic coin, token, or medal made according to a method comprising the steps of:

(a) providing an outer member from a first metal alloy, said outer member including:

(i) generally parallel, opposed face sections spaced apart a predetermined distance corresponding to the initial thickness of said outer member;

(ii) an inner plain edge devoid of grooves and teeth, the edge defining an opening in said outer member; and (iii) an outer edge;

(b) providing a core member from a second metal alloy different from said first metal alloy, said second metal alloy being harder than said first metal alloy by a predetermined relative amount, said core including:

(i) generally parallel, opposed face portions spaced apart a predetermined distance corresponding to the initial thickness of said core member, each face portion having a peripheral rim which extends a predetermined distance above its respective face portion;

(ii) a peripheral edge extending outwardly between the rims, said outer edge having a predetermined cross-sectional shape;

(iii) there being a predetermined spacing between the peripheral edge of said core member and said inner edge of said outer member, adapted to allow a closely spaced but free placement of the core member in said opening;

(c) placing said core member in the opening; and (d) plastically bonding the core member and the outer member together by plastically deforming by pressure the core member and the annular member to cause said outwardly extending peripheral edge of said core member to penetrate radially into the inner edge section of said outer member.

48. A bimetallic coin, token or medal made according to a method comprising the steps of:

(a) providing an outer member from a first metal alloy, said outer member including:

(i) generally parallel, opposed face sections spaced apart a predetermined distance corresponding to the initial thickness of said outer member;

(ii) an inner edge devoid of grooves and teeth, the edge defining an opening in said outer member; and (iii) an outer edge;

(b) providing a core member from a second metal alloy different from said first metal alloy, said second metal alloy being harder than said first metal alloy by at least about 8 points on the R30T scale, said core member having generally parallel, opposed face portions spaced apart a predetermined distance corresponding to the initial thickness of said core member, said initial thickness of said core member being substantially the same as the initial thickness of said outer member;

(c) rimming said core member to form an peripheral edge of predetermined cross-sectional shape, said peripheral edge including rim portions at or near the periphery of both face portions of the core member, said peripheral edge extending outwardly to an outermost portion with the thickness of the peripheral edge decreasing from said rim portions to said outermost portion, there being an predetermined spacing between the outermost portion of the peripheral edge of said core member and said inner edge of said outer member, adapted to allow a closely spaced but free placement of the core member in said opening;

(d) placing said core member in the opening; and (e) plastically bonding the core member and the outer member together by plastically deforming by pressure the core member and the annular member to cause said outwardly extending peripheral edge of said core member to penetrate radially into the inner edge section of said outer member.

49. A bimetallic coin, token, or medal, made according to a method comprising the steps of:

(a) manufacturing an outer, generally annular member from a first metal alloy, said outer generally annular member including:

(i) a generally cylindrical outer edge section having a predetermined outside diameter;

(ii) a generally cylindrical inner edge section having a predetermined inside diameter, defining a centrally disposed circular opening in said annular member; and (iii) a generally flat first annular face section and an opposed, generally flat second annular face section, said annular face sections being spaced apart a predetermined distance corresponding to the initial thickness of said outer annular member;

(b) manufacturing a disc-shaped core member from a second metal alloy different from said first metal alloy, said second metal alloy being harder than said first metal alloy by a predetermined relative amount, said core including:

(i) a generally flat, first face portion and an opposed, generally flat, second face portion;

(ii) said first and second face portions being spaced apart a predetermined distance corresponding to the initial thickness of said core member, each face portion having a peripheral rim which extends a predetermined distance above its respective face portion;

(iii) a peripheral edge extending outwardly between the rims, said outer edge having a predetermined cross-sectional shape; and (iv) a peripheral, edge section of predetermined cross-sectional shape and dimension extending between the face sections and having a predetermined maximum outside diameter;

(v) there being a predetermined spacing between the predetermined maximum outside diameter of the core member and said predetermined inside diameter of the outer annular member, adapted to allow a closely spaced but free placement of the core member in said opening;

(c) placing said disc-shaped core member in the opening; and (d) plastically bonding the core member and the annular member together by plastically deforming by pressure the core member and the annular member to cause said edge section of said core member to penetrate radially into the cylindrical inner edge section of said annular member to form a tongue-and-groove connection therebetween.

* * * * *